United States Patent [19]

Mollerstedt

[11] 3,996,628

[45] Dec. 14, 1976

[54] WATER CLOSETS

[75] Inventor: Karl Allan Bonde Mollerstedt, Fjalkinge, Sweden

[73] Assignee: IFO AB, Bromolla, Sweden

[22] Filed: July 3, 1975

[21] Appl. No.: 592,795

[30] Foreign Application Priority Data

July 4, 1974 Sweden ..... 7408808

[52] U.S. Cl. ..... 4/26; 4/76

[51] Int. Cl.[2] ..... E03D 3/00; E03D 11/00

[58] Field of Search ..... 4/1, 10, 26, 35, 30, 4/31, 41, 76, 77, 78, 79, 90, 82; 137/205; 222/129.2, 395

[56] References Cited

UNITED STATES PATENTS

| | | | |
|---|---|---|---|
| 3,543,309 | 12/1970 | Boone | 4/35 |
| 3,720,962 | 3/1973 | Harrah | 4/26 X |
| 3,769,637 | 11/1973 | Llamas | 4/76 X |
| 3,788,338 | 1/1974 | Burns | 4/1 X |
| 3,799,402 | 3/1974 | Meister et al. | 222/129.2 |
| 3,811,135 | 5/1974 | Drouhard et al. | 4/76 |

*Primary Examiner*—Richard E. Aegerter
*Assistant Examiner*—Stuart S. Levy
*Attorney, Agent, or Firm*—Karl W. Flocks

[57] ABSTRACT

A water closet, in particular a water closet which is connected to a discharge vacuum conduit, comprises a container which is divided into a first and second compartment by means of a movable wall, the compartments being each connected by means of a conduit to either a source of water under pressure or the flushing device of the closet pan by the intermediary of a valve mechanism. On actuation of the valve mechanism the second compartment of the container is connected to the source of water under pressure, whereby the movable wall is shifted by the water flowing into the second compartment and forces the water present in the first compartment into the flushing device of the closet pan. Once the second compartment is filled, the valve mechanism is switched by a member connected to the movable wall so that the first compartment is connected to the source of water under pressure, while the second compartment is connected to the flushing device of the closet pan so that the water present in the second compartment is supplied to the flushing device.

6 Claims, 1 Drawing Figure

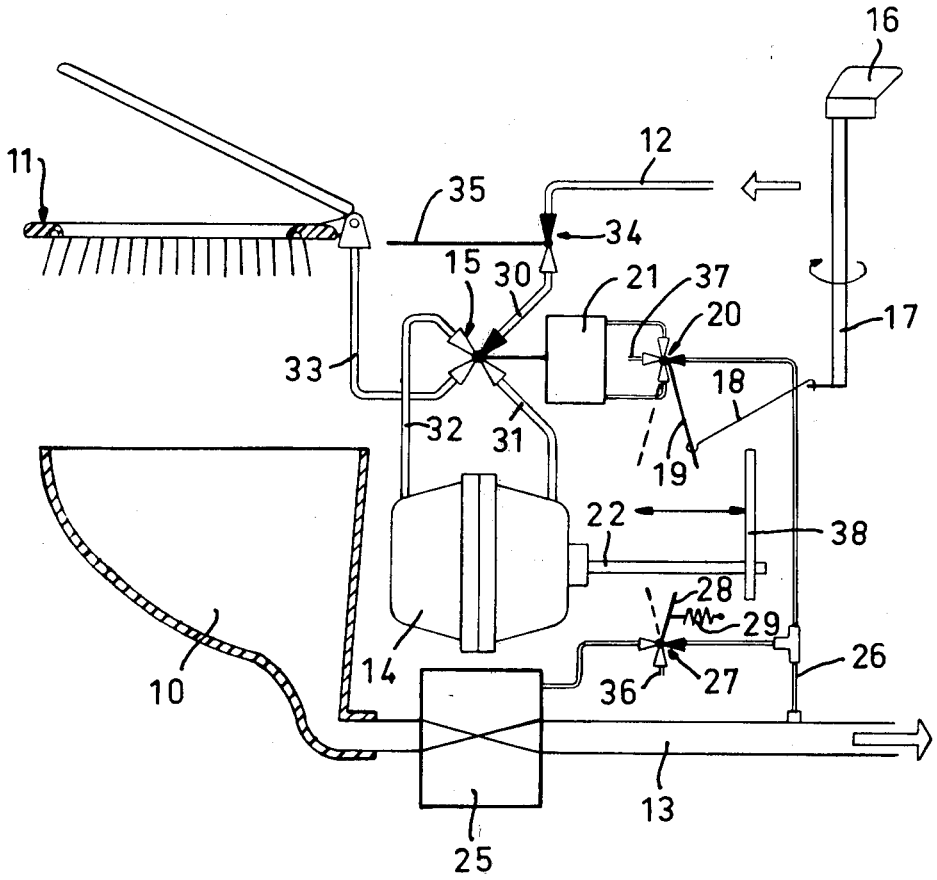
16
12
11
35
34
15
30
21
37
20
17
33
18
32
31
19
22
38
28
29
26
10
14
36
27
13
25

WATER CLOSETS

The present invention relates to a water closet.

Water closets are normally provided with a flushing cistern which is connected to the closet pan by means of a channel fitted with a valve. The conventional flushing cistern has a definite minimum volume and in cases where the flushing cistern is not directly connected to the closet pan it must be built into a wall located adjacent the closet pan. In both alternatives, the cost of the flushing cistern proper constitutes a substantial portion of the total production or installation cost of the water closet.

In water closets which are connected to customary sewage systems, only one operation takes place in connection with the emptying of the closet pan, namely the opening of the flushing valve which is subsequently closed automatically by the water pressure. On the other hand, in a vacuum system, that is to say, a system in which the closet is connected via a discharge valve to a vacuum discharge conduit, several operations must be effected in the correct mutual sequence. Naturally, this can be effected by means of electric or electronic equipment, but it would be advantageous if the mains pressure and/or the effect of the vacuum could also be used in this type of closet for executing all of the necessary operations apart from the initiation of the flushing cycle.

The object of the present invention is primarily to provide a new flushing cistern which is of a completely different design from present day cisterns and is of substantially smaller dimensions. Despite its small size, this flushing cistern is able to measure accurately the required amount of flushing water. Moreover, this flushing cistern affords an absolutely reliable control of the entire flushing and emptying cycle, in particular in a vacuum system.

According to the invention, the flushing cistern of the closet comprises a closed container whose interior is divided into a first and a second compartment separated by means of a movable wall, for example a diaphragm, a piston etc, the compartments being each connected by means of a conduit to either the water mains or other source of water under pressure, or the flushing device of the closet pan by the intermediary of a valve mechanism which, on manual actuation, connects the second compartment of the container to the water mains, the movable wall being shifted by the water, which flows into the second compartment, and forcing the water present in the first compartment into the flushing device of the closet pan, and once the first compartment has been emptied, the valve mechanism is arranged to be switched by means of members actuated by the movable wall so that the first compartment is connected to the water mains for filling and the water present in the second compartment is forced by the movable wall into the flushing device of the closet pan.

The invention will be described in greater detail hereinbelow and with reference to the accompanying drawing which schematically illustrates an embodiment of the invention.

The water closet shown in the drawing has a pan 10 with a seat 11 and a lid therefor, the seat being shown spaced a distance from the upper open end of the closet pan for purposes of clarity. The seat 11 is of the type in which the flushing water is supplied to a channel in the seat from which channel the water flows out through a number of openings in the underside of the seat. A water supply conduit is designated 12 and a discharge conduit is designated 13. The discharge conduit is part of a vacuum discharge system, that is to say, the contents of the closet pan 10 are removed by means of the vacuum prevailing in the discharge system. The discharge conduit 13 is connected to the closet pan 10 by the intermediary of a discharge valve 25. The supply of flushing water to the seat 11 is effected through a flushing cistern 14 and a valve mechanism 15 which will be described in greater detail below. A manually operable handle 16 is provided for initiating the flushing and emptying cycle.

The flushing cistern 14 consists of a closed container which accommodates a movable wall (not shown), for example, a diaphragm or piston, by means of which the interior of the container 14 is divided into two separate compartments. A rod 22, slidably mounted in the casing of the container 14, is fixedly attached to this movable wall and it will be realized that if the movable wall is reciprocated the rod 22 will follow the movement of the wall. The first compartment of the container 14 is connected to the valve mechanism 15 by a conduit 32 and the second compartment of the container 14 is connected to the valve mechanism 15 by a conduit 31. The seat assembly 11 is also connected to the valve mechanism 15 by a conduit 33. Moreover, the valve mechanism 15 and the water supply conduit 12 are connected to each other by a conduit 30. Thus, both of the compartments of the container 14 can be connected to either the seat 11 or the water supply conduit 12 by the valve mechanism 15, as will be more clearly apparent from the following description.

A power souce in the form of a vacuum motor 21 is provided for operating the valve mechanism 15. The vacuum motor may be connected, via a control valve 20, to either the atmosphere via an inlet pipe 37 or the vacuum in the discharge conduit 13 via a conduit 26. A rocker 19 is provided for operating the control valve 20 of the vacuum motor 21. The rocker 19 may, in turn, be actuated by means of the manual operating handle 16 by the intermediary of a stem 17 and a link 18 or an operating member 38 on the rod 22 connected to the movable wall in the container 14.

The discharge valve 25 is of a per se known type, in which atmospheric pressure is allowed to act on an operating means so that atmospheric pressure and the vacuum in the discharge conduit 13 together cause shut-off. The atmospheric pressure is conducted to the operating means of the discharge valve 25 through a conduit 36 in a valve 27. However, this valve 27 may be switched by means of a rocker 28 so that the vacuum in the discharge conduit 13 is transferred to the operating means of the discharge valve through the conduit 26 and the valve 27. It will be realized that the shut-off function of the operating means is thereby cancelled out, the discharge valve 25 is opened and communication is established between the closet pan 10 and the discharge conduit 13. Normally, the rocker 28 of the valve 27 is maintained, by means of a spring 29, in the position in which the operating means of the discharge valve 25 is in communication with the atmosphere, the rocker being shifted to the position in which the discharge valve 25 is opened, by means of the previously-mentioned operating member 38 on the rod 22, because of the fact that the rocker 28 is in the path of movement of the operating member 38, as will be more clearly apparent from the following description of the function of the water closet.

In view of the fact that the flushing is effected by means of a channel disposed in the toilet seat, it would be highly inconvenient if the flushing were to be effected with the seat in the raised position. For this reason, an operating means 35 is connected to the seat, and said operating means, in its turn, actuates a valve 34 in the water supply conduit such that the valve 34 is open only when the seat 11 is in the lowered position, thus precluding the risk that flushing occurs when the seat is in the raised position.

A flushing cycle will now be described in greater detail. Suppose that the seat 11 is in the lowered position as shown on the drawing, the valve 34 being consequently open. The water supply conduit 12 is in communication with the conduit 32 and the first compartment of the container 14 by the intermediary of the valve mechanism 15, in which position the movable wall in the container 14 is forced as far as possible to the right on the drawing. The rod 22 and the operating member 38 are, like the movable wall, in position farthest to the right on the drawing. The rocker 19 for the control valve 20 of the vacuum motor 21 is in the position shown by a broken line, in which position the vacuum motor 21 is connected to the atmosphere through the inlet pipe 37. The rocker 28 for the control valve 27 of the discharge valve 25 is maintained, by means of the spring 29, in the position indicated by a full line. If the operating handle 16 is now turned manually in the direction shown by an arrow, the rocker 19 is shifted by means of the stem 17 and the link 18 to the position shown by a full line, the communication between the vacuum motor 21 and the atmosphere being then broken and the vacuum motor instead being connected to the vacuum in the discharge conduit 13 via the conduit 26. The vacuum motor 21 is thereby actuated and switches the valve mechanism 15 such that communication between the first, water-filled compartment of the container 14 and the seat 11 is established through the conduits 32 and 33 at the same time as the second compartment of the container 14 is connected to the water supply conduit 12 through conduits 30 and 31. The movable wall in the container 14 is then forced to the left on the drawing and the water in the first compartment is forced through conduits 32 and 33 to the seat and out through the openings therein for flushing the closet pan 10. Because the movable wall is now shifted to the left, the rod 22 and the operating member 38 are also shifted to the left and, after a certain distance, the operating member 38 strikes the rocker 28 and shifts it towards the position shown by a broken line. When the rocker has arrived at this position, the discharge valve 25 is opened and the waste matter in the closet pan 10 is removed by suction by the vacuum prevailing in the discharge conduit 13. The rocker 19 is also struck by the operating member 38 and, in the position shown by a broken line, once again switches the valve 20 so that the vacuum motor 21 is once again connected to the atmosphere and the valve mechanism 15 is switched to the initial position, in which the channel in the seat 11 is in communication with the second compartment of the container 14 through conduits 33 and 31, while the first compartment of the container 14 is in communication with the water supply conduit 12 so that the first compartment in the container 14 is refilled, while the water in the second compartment is emptied into the closet pan 10. The rod 22 and the operating member 38 are now once again shifted to the position shown on the drawing, the rocker 19 remaining in the position shown by a broken line, ready for reactuation by means of the operating handle 16, while the rocker 28 is returned by the spring 29 to the position shown by the full line. A certain amount of water is introduced even after the discharge valve 25 has been closed, so that water is held in the bottom of the closet pan 10. The closet is now ready for a new flushing cycle.

Although the water closet according to the present invention is shown and described with particular reference to a vacuum discharge system, it is readily understood that the flushing container 14 with associated parts may also be used in a conventional water closet. However, the water closet according to the present invention is particularly well suited to the vacuum system because of the operating movement produced by means of the movable wall, and it will be realized that the closet is automatically put out of action when the water suply ceases and/or when the vacuum in the discharge conduit 13 is reduced or cancelled. As a result, the present invention provides a fully safe system.

The water closet according to the present invention may be modified in a number of ways without departing from the spirit and scope of the appended claims and the above description should not, therefore, be considered as limitative of the spirit and scope of the invention.

What I claim and desire to secure by Letters Patent is:

1. A water closet comprising a closet pan, a flushing cistern in the form of a closed container, a movable wall in said container shiftable by water in the container, said wall dividing said container into a first compartment and a second compartment separated from said first compartment, a valve mechanism, conduits extending from said first and second compartments in said container to said valve mechanism and from said valve mechanism to a source of water under pressure and to the flushing device of said closet pan, said valve mechanism being operative by manual actuation means, and connecting said second compartment of said container to said source of water under pressure and said first compartment to said flushing device of said closet pan, with the result that said movable wall is shifted by the water in the said container which flows into said second compartment and forces the water present in said first compartment into said flushing device of said closet pan, and means coupled between said valve mechanism and said movable wall to actuate said valve mechanism upon movement of said movable wall such that said first compartment is connected to said souce of water under pressure for filling and the water present in said second compartment is forced into said flushing device of said closet pan.

2. A closet as claimed in claim 1, in which said means by which said movable wall actuates said valve mechanism comprises a mechanical link.

3. A closet as claimed in claim 2, in which the outlet of said closet pan is connected to a vacuum discharge conduit by the intermediary of a discharge valve whose control means is actuated by means of said link connected to said movable wall.

4. A closet as claimed in claim 3, in which a vacuum motor is connected to the vacuum connection to said discharge conduit and is disposed to operate said valve mechanism of said container, said vacuum motor having control means via which are connected said manual actuation means and said actuation effected by means of said link connected to said movable wall.

5. A closet as claimed in claim 4, in which said link connected to said movable wall comprises a rod fixedly connected to said wall and projecting from said closed container, said rod having transverse projections on its portion projecting from said container, and said control means on said vacuum motor and said discharge valve having rockers on the control means and said discharge valve placed in the path of movement of said projections so as to be actuated by said projections.

6. A closet as claimed in claim 4, in which said control means of said vacuum motor and said discharge valve comprise valves which are connected to the vacuum connection to said discharge conduit and to the atmosphere.

* * * * *